US006011538A

United States Patent [19]

Eglit

[11] Patent Number: 6,011,538

[45] Date of Patent: Jan. 4, 2000

[54] METHOD AND APPARATUS FOR DISPLAYING IMAGES WHEN AN ANALOG-TO-DIGITAL CONVERTER IN A DIGITAL DISPLAY UNIT IS UNABLE TO SAMPLE AN ANALOG DISPLAY SIGNAL AT A DESIRED HIGH SAMPLING FREQUENCY

[75] Inventor: Alexander Julian Eglit, Half Moon Bay, Calif.

[73] Assignee: Paradise Electronics, Inc., San Jose, Calif.

[21] Appl. No.: 08/877,708

[22] Filed: Jun. 18, 1997

[51] Int. Cl.[7] ..... G09G 5/00

[52] U.S. Cl. ..... 345/127; 345/213; 348/439; 348/581

[58] Field of Search ..... 345/127, 128, 345/129, 130, 131, 213, 132; 348/439, 581, 578, 448, 458

[56] References Cited

U.S. PATENT DOCUMENTS

| | | | |
|---|---|---|---|
| 4,402,010 | 8/1983 | Vogelman | 358/133 |
| 4,417,233 | 11/1983 | Inoue et al. | 340/347 AD |
| 4,743,843 | 5/1988 | Tada | 324/114 |
| 4,768,017 | 8/1988 | Gordon | 340/347 SH |
| 4,937,579 | 6/1990 | Maio et al. | 341/165 |
| 4,994,806 | 2/1991 | Yun-Tae | 341/155 |
| 5,168,270 | 12/1992 | Masumori et al. | 340/784 |
| 5,365,527 | 11/1994 | Honma | 371/25.1 |
| 5,392,044 | 2/1995 | Kotzin et al. | 241/155 |
| 5,450,085 | 9/1995 | Stewart et al. | 341/159 |
| 5,537,157 | 7/1996 | Washino et al. | 348/722 |
| 5,541,665 | 7/1996 | Urata et al. | 348/571 |
| 5,546,531 | 8/1996 | Lippincott | 395/164 |
| 5,585,796 | 12/1996 | Svensson et al. | 341/155 |
| 5,604,513 | 2/1997 | Takahashi et al. | 345/153 |
| 5,619,226 | 4/1997 | Cahill, III | 345/132 |
| 5,625,359 | 4/1997 | Wilson et al. | 341/143 |
| 5,742,274 | 4/1998 | Henry et al. | 345/132 |

*Primary Examiner*—Steven J. Saras
*Assistant Examiner*—Fritz Alphonse
*Attorney, Agent, or Firm*—Law Firm of Naren Thappeta

[57] ABSTRACT

A digital display unit including an analog to digital converter (ADC). When the optimal sampling frequency for sampling an analog display signal is greater than the maximum sampling frequency of the ADC, the analog display signal is sampled using 2:1' interleaved sampling. A smaller image represented by the sampled values is then upscaled prior to being displayed. Such upscaling compensates for the decreased number of samples that would be generated by sampling at lower sampling frequency during 2:1 interleaved sampling.

19 Claims, 7 Drawing Sheets

METHOD AND APPARATUS FOR DISPLAYING IMAGES WHEN AN ANALOG-TO-DIGITAL CONVERTER IN A DIGITAL DISPLAY UNIT IS UNABLE TO SAMPLE AN ANALOG DISPLAY SIGNAL AT A DESIRED HIGH SAMPLING FREQUENCY

RELATED APPLICATIONS

The present application is related to the following co-pending Patent Applications, which are both incorporated in their entirety into the present application herewith:

1. Patent Application entitled, "A Method and Apparatus for Upscaling an Image", Filed Feb. 24, 1997, having Ser. No. 08/804,623 and Attorney Docket Number: PRDN-0001;

2. Patent Application entitled, "A Method and Apparatus for Clock Recovery in a Digital Display Unit", Filed Feb. 24, 1997, having Ser. No. 08/803,824 and Attorney Docket Number: PRDN-0002;

3. Patent Application entitled, "A method and Apparatus for Automatically Determining Signal Parameters of an Analog Display Signal Received by a Display Unit of a Computer System", filed Jun. 10, 1997, and having Ser. No. 08/872,764, and 4. Patent Application entitled, "A Method and Apparatus Implemented in a Computer System for Determining the Frequency Used by a Graphics Source for Generating an Analog Display Signal", Ser. No.: UNASSIGNED, Filed Jun. 10, 1997, and having Ser. No. 08/872,774.

BACKGROUND OF THE INVENTION

1. Field of the Invention

The present invention relates to computer graphics systems, and more specifically to a method and apparatus for displaying images on a digital display unit when an analog-to-digital converter (ADC) may be unable to sample an analog display signal at a desired high sampling frequency.

2. Related Art

Digital display units are often used to display images in computer systems. A digital display unit typically receives an analog display signal (e.g., in RGB format) and generates an image encoded in the analog display signal. Digital display units are characterized by discrete points (termed pixels) on a display screen usually contained in each digital display screen. Each point is generally actuated to a varying degree as determined by a received analog display signal. Such actuation generates an image encoded in the received analog display signal.

Analog display signals usually contain multiple frames (hereafter "display signal frames"), with each frame containing multiple horizontal lines. Each display signal frame typically represents an image to be displayed on a digital display screen at a given instance in time. In response to receiving multiple display signal frames, a digital display unit refreshes a display screen with individual images encoded in the received individual display signal frames. Accordingly, a digital display unit may need to display images encoded in the received display signal frames at the same rate as that at which the display signal frames are received. In general, a higher refresh rate (which usually equals the received frame rate) results in an image of a better display quality. Therefore, there is a general need to provide analog display signals at high frame rates.

Digital display units often contain an analog to digital converter (ADC) to sample each display signal frame. The sampled values are commonly used to determine the degree to which each pixel of a digital display screen is to be actuated. A typical ADC needs to sample each horizontal line of a frame a desired number of times. Thus, the desired sampling rate (number of samples per second) of an ADC in a digital display unit is generally computed by multiplying the three factors—the desired number of times each horizontal line has to be sampled, the number of vertical lines in each frame and the number of frames received in each second (frame rate).

For example, in a conventional VGA environment with 800 samples per each horizontal line, 525 vertical lines per frame and with a frame rate of 60 Hz (frames/second), an ADC with a sampling rate of about 25.2 MHZ may be needed. On the other hand, for high resolution monitors with higher frame rates, ADCs having sampling rates as high as 170 MHZ may be needed. In general, the desired sampling frequencies are increasing over time in an attempt to provide better display quality which results from higher frame rates (refresh rates).

Unfortunately, ADCs with higher sampling rates (e.g., 170 MHz) can be expensive, and therefore undesirable in certain situations. In addition, the high sampling rates may not be needed when operating with display signals having lower frame rates. Thus, it may be desirable to provide an ADC with low sampling rate in a digital display unit, but provide a scheme which enables the display of images encoded in display signal frames with high frame rates.

Therefore, what is needed is a method and apparatus for displaying images on a digital display unit when an analog-to-digital converter is unable to sample an analog display signal at a desired high sampling frequency.

SUMMARY OF THE INVENTION

The present invention is described in the context of a digital display unit implemented in a computer system. The digital display unit includes a analog-to-digital converter (ADC) for sampling an analog display signal. The analog display signal has an optimal sampling frequency associated with it. When sampled at such an optimal sampling frequency, a high quality image can generally be generated on a digital display screen included in the digital display unit.

However, if the optimal sampling frequency is greater than the maximum sampling frequency of the ADC, the digital display unit samples the analog display signal at a lower sampling frequency than the optimal sampling frequency. Due to the lower sampling frequency, a smaller number of samples are generated for each frame of the analog display signal. A smaller image represented by the smaller number of samples is interpolated to generate an upscaled image. Such upscaling compensates (in terms of size) for the smaller number of samples resulting from sampling at lower frequency.

In one embodiment of the present invention, a digital display unit samples an analog display signal using 2:1 interleaved sampling if the optimal sampling frequency is greater than the maximum sampling frequency of the ADC. In interleaved sampling, only half of the optimal positions (i.e., positions which would have been sampled had optimal frequency been used) in alternate positions are sampled for each frame. Also, the half positions which are not sampled during a previous frame are sampled in a frame present.

To perform 2:1 interleaved sampling, a clock generator generates a clock signal with an optimal sampling frequency. A pixel qualifier generator generates a pixel qualifier signal, which when ANDed with the clock signal generates a sampling clock for interleaved sampling. Thus, the ADC can sample at a lower sampling frequency, which is less than or equal to the maximum sampling frequency of the ADC.

In one embodiment, an interpolator is used to generate twice the number of pixels by interpolating the pixels resulting from 2:1 interlaced sampling. Thus, the output of the interpolator contains a number of pixels equal to those that would have been generated had the analog display signal been sampled at the optimal sampling frequency. The output of the interpolator is optionally provided to an upscaler which operates to fit the image into the entire area of a digital display screen.

In an alternative embodiment, the functions of the interpolator and upscaler are combined into one upscaler. Besides performing 2:1 upscaling in the horizontal direction, the upscaler in this embodiment operates to upscale the output of ADC to fit the entire area (or any desired size) of a digital display screen.

Thus, the present invention enables the display of images encoded in an analog display signal even if an optimal sampling frequency associated with a display signal is greater than the maximum sampling frequency of an ADC included in the digital display unit.

The present invention can be implemented with minimal additional hardware as an upscaler which may be otherwise needed, is used to compensate for the smaller number of samples which result from sampling at lower sampling frequency.

Also, any degradation in display image quality due to the lower sampling rate may be acceptable as can be appreciated by considering the effect of the operation of the present invention in two cases, namely, when display images change substantially across frames and when display images do not change substantially across frames. If the display images do not change substantially, the display data values do not change substantially in successive frames for unsampled positions. As the unsampled positions in a present frame are sampled in a subsequent frame, the pixels corresponding to these positions are actuated to the same degree when this subsequent frame is processed. If the display images change substantially across frames, the detail lost will not be perceived by the human eye as the spatial resolution of human eye decreases with moving images.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

Figure 1:
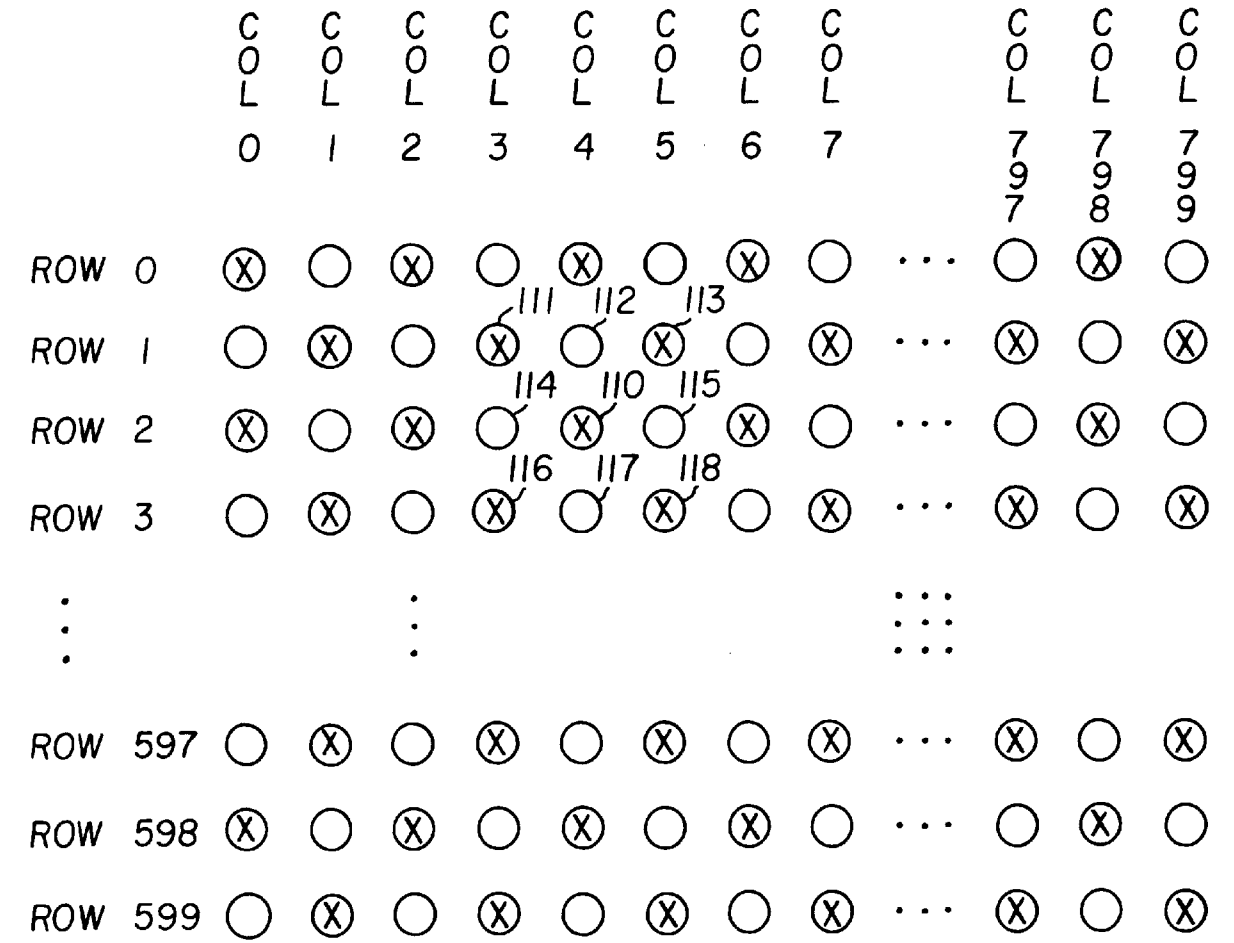
FIG. 1 is a diagram of several pixels generated from sampling an analog display signal illustrating 2:1 interleaved sampling.

1. Overview and Discussion of the Invention

The present invention is described in the context of a digital display unit, which includes an analog-to-digital converter (ADC) for sampling an analog display signal received from an external graphics source. An optimal sampling frequency is generally associated with each analog display signal. Optimal sampling frequency generally refers to a desired sampling frequency which would generate a high quality display (on a digital display screen) of an image encoded in a received analog display signal. The optimal sampling frequency may be measured by multiplying the three factors—frame rate (i.e., the number of frames received per second), the number of horizontal lines within each frame, and a total number of positions to sample per each horizontal line.

The total number of positions to sample per horizontal line and sampling frequency can be determined, for example, as described in co-pending Patent Applications entitled, "A method and Apparatus for Automatically Determining Signal Parameters of an Analog Display Signal Received by a Display Unit of a Computer System", filed Jun. 10, 1997, and having Ser. No. 08/872,764, and entitled, "A Method and Apparatus Implemented in a Computer System for Determining the Frequency Used by a Graphics Source for Generating an Analog Display Signal" Ser. No.: UNASSIGNED, Filed Jun. 10, 1997, and having Ser. No. 08/872,774, which are both incorporated in their entirety herewith.

The analog display signal is sampled at a set of optimal positions when sampled at the optimal sampling frequency. As a result of such sampling, an optimal set of pixels with each corresponding to a sampled optimal position are generally generated. Each pixel is represented by a optimal sampled value. The number of positions in the set of optimal positions will be referred to as optimal number.

When the maximum sampling frequency of an ADC is less than the optimal sampling frequency of an analog display signal, the digital display unit samples the analog display signal at a sampling frequency which is less than the optimal frequency. As a result, the analog display signal is sampled at a number of positions less than the optimal number. Such sampling results in the generation of a smaller set of sampled pixels compared to the optimal set of pixels. The sampling frequency is chosen such that the generated smaller set of sampled pixels will be representative of a downscaled version of the image encoded in the analog display signal. The downscaled version is then upscaled to generate the image encoded in the analog display signal.

Alternatively, the downscaled image may be upscaled to fit the display screen generally present in the digital display unit.

Several embodiments of the present invention will be described in further detail below. Before describing the invention in great detail, it is useful to describe an example environment in which the invention can be implemented. The details of making and using the invention will be clear from the description.

2. Example Environment

In a broad sense, the invention can be implemented in any computer system having a digital display unit. Such systems include, without limitation, lap-top and desk-top personal computer systems (PCS), work-stations, special purpose computer systems, general purpose computer systems, and many others. The invention may be implemented in hardware, software, firmware, or combination of the like.

Figure 2:
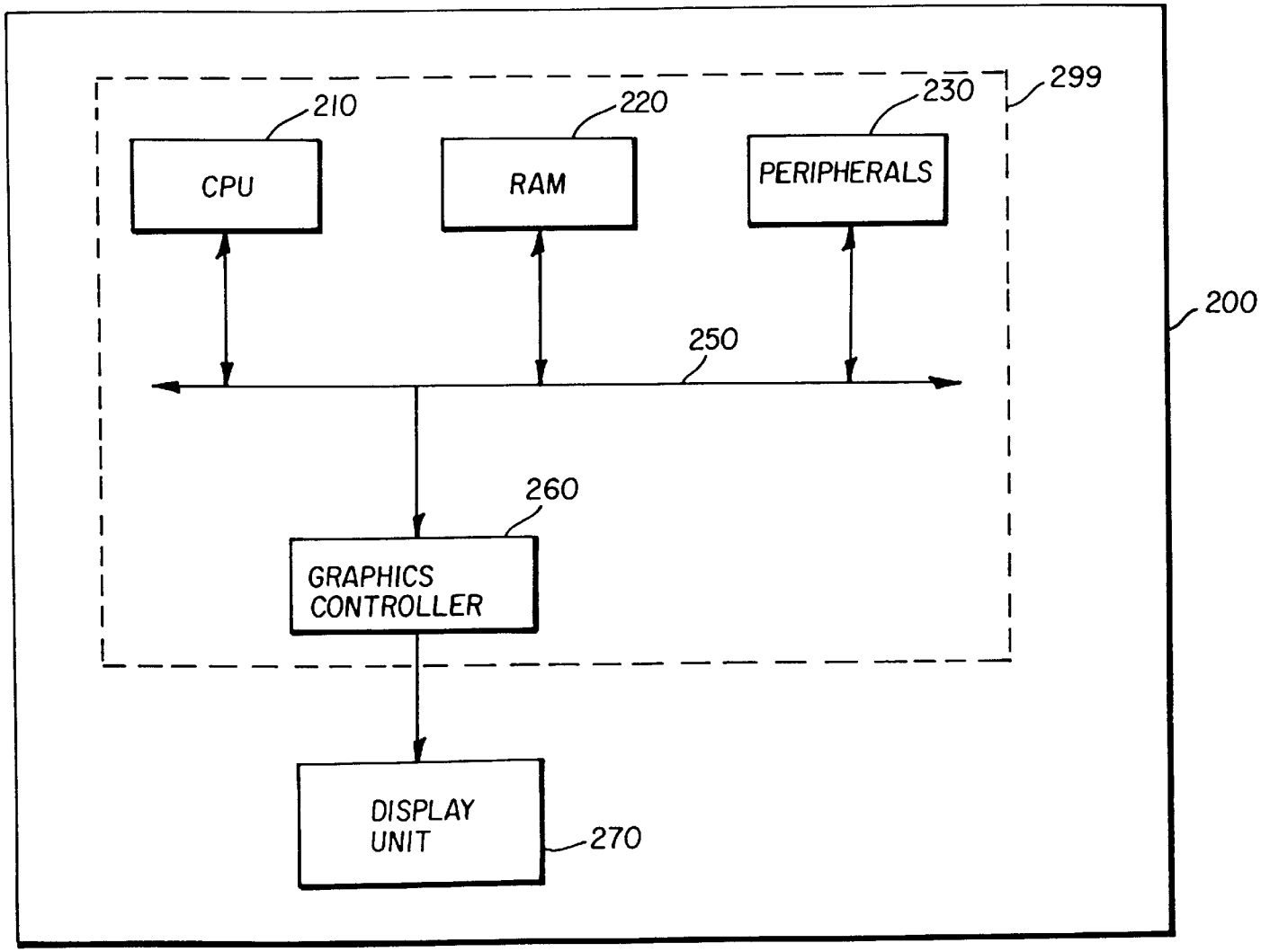
FIG. 2 is a block diagram of an example computer system in which the present invention can be implemented.

FIG. 2 is a block diagram of computer system 200 in which the present invention can be implemented. Computer system 200 includes central processing unit (CPU) 210, random access memory (RAM) 220, one or more peripherals 230, graphics controller 260, and digital display unit 270. CPU 210, RAM 220 and graphics controller 260 are typically packaged in a single unit, and such a unit is referred to as graphics source 299 as the analog display signal is generated by the unit. All the components in graphics source 299 of computer system 200 communicate over bus 250, which can in reality include several physical buses connected by appropriate interfaces.

RAM 220 stores data representing commands and possibly pixel data representing an image. CPU 210 executes commands stored in RAM 220, and causes different commands and pixel data to be transferred to graphics controller 260. Peripherals 230 can include storage components such as hard-drives or removable drives (e.g., floppy-drives). Peripherals 230 can be used to store commands and/or data which enable computer system 200 to operate in accordance with the present invention. By executing the stored commands, CPU 210 provides the electrical and control signals to coordinate and control the operation of various components.

Graphics controller 260 receives data/commands from CPU 210, generates an analog signal and a corresponding reference signal(s), and provides both to display unit 270. The analog signal can be generated, for example, based on pixel data received from CPU 210 or from an external encoder (not shown). Alternatively, graphics controller 260 can generate pixel data representative of a new image based on commands received, for example, from CPU 210. Graphics controller 260 then generates an analog signal based on such pixel data. In one embodiment, the analog signal is in the form of RGB signals and the reference signal includes the VSYNC and HSYNC signals well known in the art. However, it should be understood that the present invention can be implemented with analog image data and/or reference signals in other standards. Examples of such standards include composite sync standard usually implemented on Macintosh Computer Systems and Sync on Green standard.

Digital display unit 270 receives an analog display signal from a graphics source (e.g., 299) and generates the display signals. The display signals cause an image (encoded in the analog display signal) to be generated on a digital display screen usually provided within digital display unit 270. Digital display unit 270 includes an analog to digital converter (ADC) for sampling the received analog display signal and generating pixel data. Display signals are generally provided based on the pixel data.

Ideally, an analog signal should be sampled with an optimal frequency to generate the pixel data. However, if the maximum sampling frequency of ADC is less than the optimal frequency, digital display unit 270 samples the analog display signal at a frequency less than the optimal frequency. The representative image resulting from such sampling is upscaled later as will be explained below. The method of the present invention will be explained first, followed by an apparatus/circuit to implement the method.

3. A Method According to the Present Invention

Figure 6:
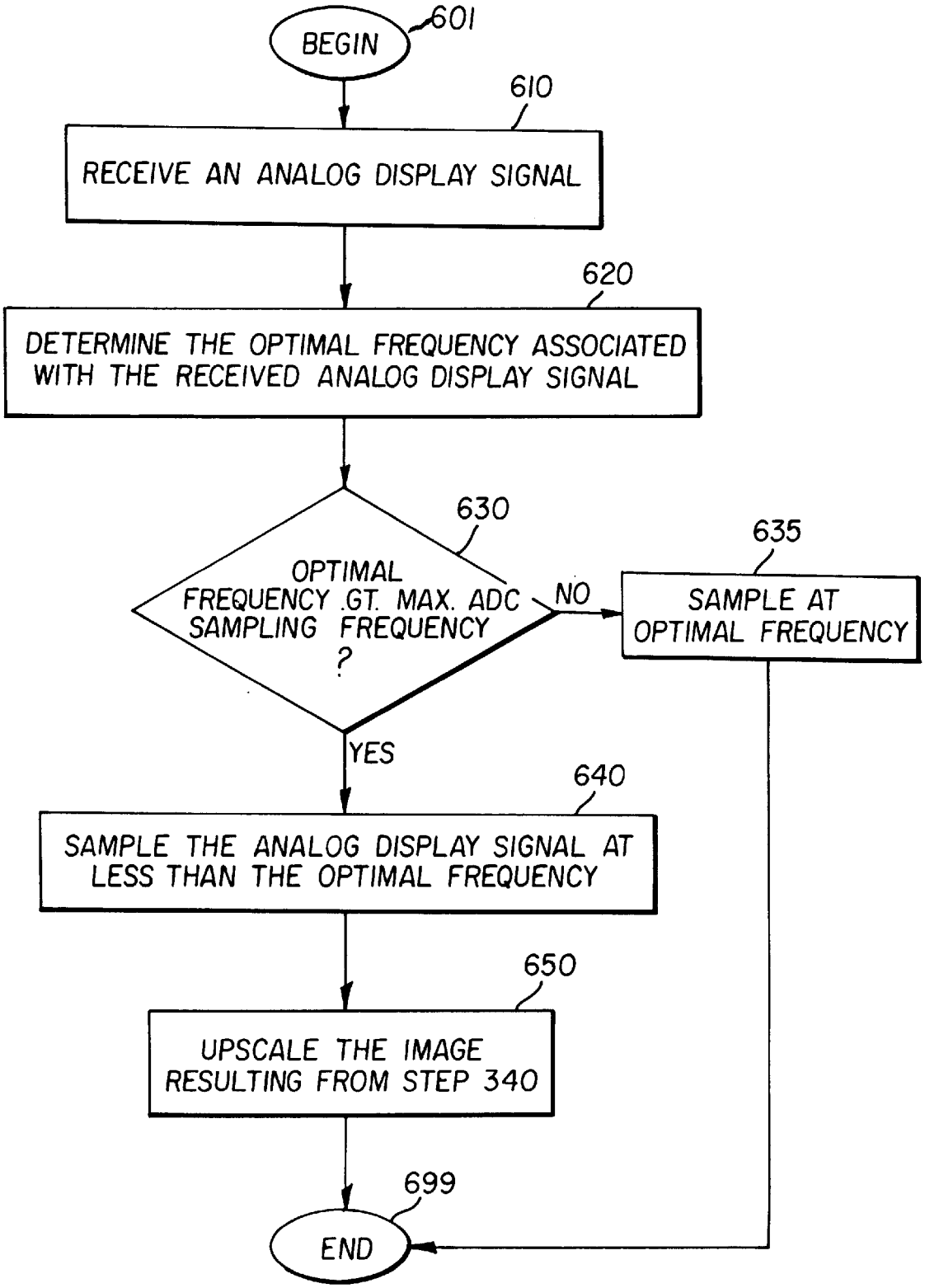
FIG. 6 is a flowchart illustrating a method according to the present invention.

FIG. 6 is a flowchart illustrating the method of the present invention. The method will be explained with reference to computer system 200 of FIG. 2. However, the present invention can be practiced with digital display units in other environments when receiving analog display signals from other graphics sources.

In step 610, digital display unit 270 receives an analog display signal from a graphics source. In step 620, digital display unit 270 determines the optimal frequency for sampling the received analog display signal. An optimal frequency of an analog display signal generally refers to a desired sampling frequency which produces a high quality display of an image encoded in the analog display signal. One method of computing the optimal frequency is explained above in the section entitled '1. Overview and Discussion of the Invention'.

In step 630, digital display unit 270 determines whether the optimal frequency is greater than a maximum sampling frequency at which the ADC (included within digital display unit 270) can operate at. If the optimal frequency is not greater than the maximum sampling frequency, digital display unit 270 samples the received analog display signal at the optimal frequency in step 635, and generates display signals in a well-known way.

If the optimal frequency is greater than the maximum sampling frequency of the ADC, digital display unit 270 samples the analog signal at a frequency ("sampling frequency") less than the optimal frequency. The sampling frequency is chosen such that a smaller set of pixel data elements (compared to sampling at the optimal frequency) representative of the image encoded in the received analog display signal are generated.

In one embodiment explained below, the sampling frequency is chosen to be ½ the optimal sampling frequency to perform 2:1 interleaved sampling. As only ½ of the positions (which would have been sampled with optimal frequency) would be sampled during interleaved sampling, a first set of ½ of these positions are sampled during odd frames and the remaining ½ of the positions are sampled during even frames.

It should be understood that very little detail will be lost due to interleaving if the images do not change significantly from frame to frame as unsampled positions in one frame are sampled in the next frame, and the display data for the unsampled positions does not change from the one frame to the next frame. Even if the images change significantly from one frame to the next frame, the detail lost will not be perceived by the human eye as the spatial resolution of human eye decreases with moving (changing) images.

In step 650, the image represented by the smaller set of pixel data elements is upscaled to generate an image of a desired size. The desired size can be the size of the image that would have been generated had the analog display signal been sampled at the optimal frequency or the size of the digital display screen or any other size (e.g., to fit into a desired window size in a graphics environment).

Thus, the present invention enables a digital display unit to display an image encoded in an analog display signal even when the maximum sampling frequency of ADC is less than the optimal frequency associated with the analog display signal.

As noted above, in one embodiment, digital display unit 270 employs interleaved sampling to generate the smaller set of pixel data elements in step 640. Therefore, interleaved sampling is illustrated below with an example. The manner in which digital display unit 270 uses and implements interleaved sampling in one embodiment will then be explained below in detail.

4. Interleaved Sampling

Interleaved sampling is explained with reference to FIG. 1, which includes the 800 (Col.s 0–799)×600 (Rows 0–599) pixel data elements which would be generated if an analog display signal is sampled at an optimal frequency. As the optimal frequency is greater than the sampling frequency at which an ADC in a digital display unit can operate, the analog display signal needs to be sampled at a lower frequency.

Thus, in the example illustrated with reference to FIG. 1, the analog display signal is sampled at half the sampling frequency. When sampled at half the optimal frequency, only half the pixel data elements of FIG. 1 are generated. Accordingly, digital display unit 270 samples all the pixels represented by '⊗' in even frames and all pixels represented by 'O' in odd frames. Thus, of the 800×600 pixels, only 400×600 pixels are sampled in each frame. As will be explained below, the image represented by the 400×600 pixel data elements is upscaled prior to being displayed.

Even though half the optimal frequency is used in the description here, it should be understood that the analog display signal can be sampled at a different frequency (e.g., ⅓ the optimal frequency to correspond to 3:1 interleaved sampling) without departing from the scope and spirit of the present invention. Such implementations will be apparent to one skilled in the relevant arts by reading the description provided herein. Similarly, schemes other than interleaved sampling also can be used to generate the smaller set of pixel data elements representative of the image encoded in the received analog display signal.

Example implementations of digital display unit 270 which operate in accordance with the present invention will be explained now in detail.

5. An Example Embodiment of Digital Display Unit

Figure 3A:
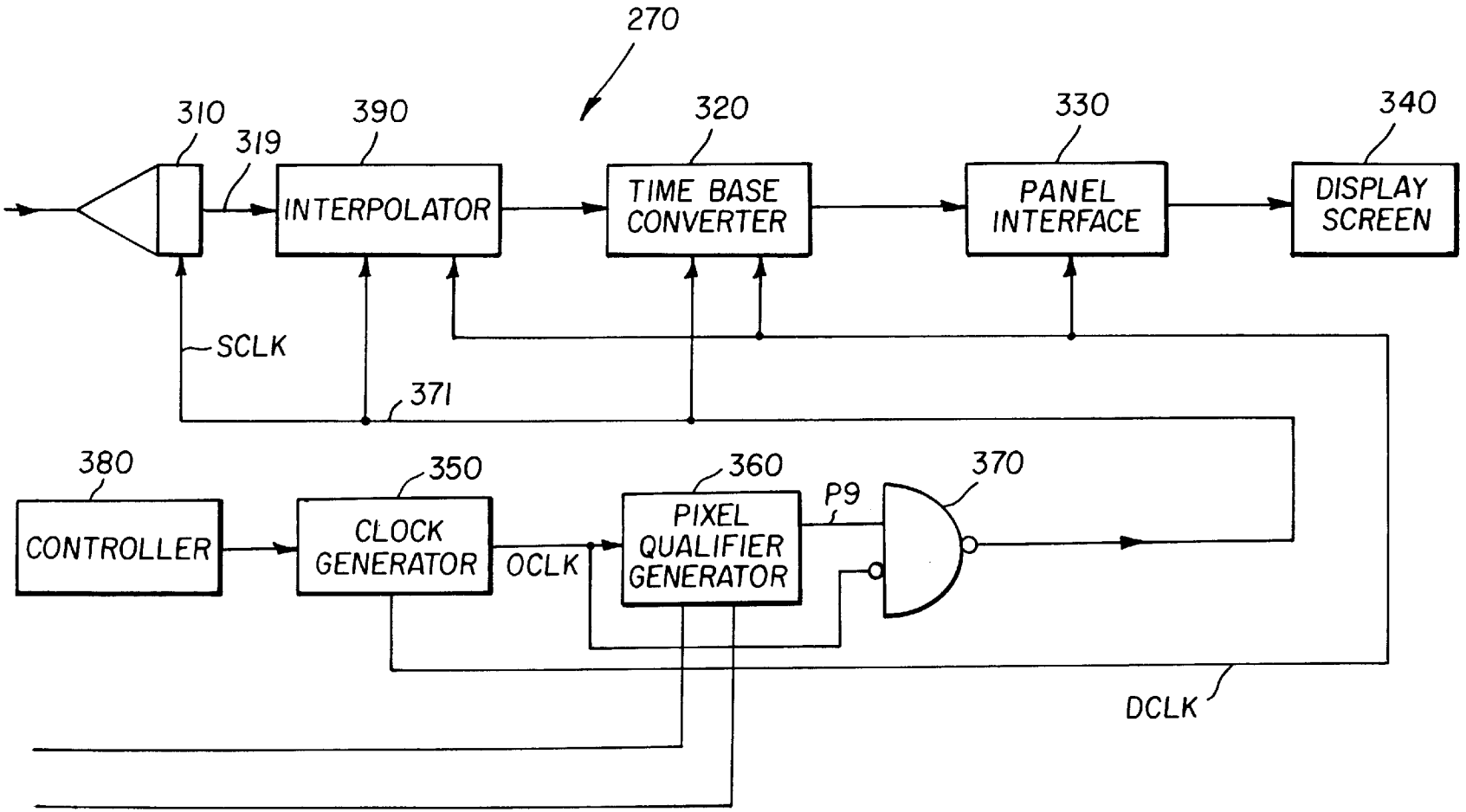
FIG. 3A is a block diagram of an embodiment of a digital display unit including an analog to digital converter (ADC) illustrating the manner in which an image encoded in an analog signal can be displayed even if the maximum sampling frequency of the ADC is less than an optimal sampling frequency of the analog display signal.

FIG. 3A is a block diagram of digital display unit 270 including analog-to-digital converter (ADC) 310, time base convertor (TBC) 320, panel interface 330, digital display screen 340, clock generator circuit 350, pixel qualifier generator 360, NAND gate 370, control circuit 380, and interpolator 390. Each of these components will be explained in further detail below.

Clock generator 350 generates the clock signals to drive the remaining components as will be explained below. An embodiment of clock generator is explained in co-pending patent application entitled, "A Method and Apparatus for Clock Recovery in a Digital Display Unit", Filed Feb. 24, 1997, having Ser. No. 08/803,824 and Attorney Docket Number: PRDN-0002.

ADC 310 receives an analog display signal on line 301 and samples the received analog display signal according to the sampling clock (SCLK) line 371. The present invention ensures that the sampling frequency received on sampling clock line 371 is less than the maximum sampling frequency of ADC 310. ADC 310 provides the sampled values on line 312.

Pixel qualifier generator 360 and NAND gate 370 operate to generate a sampling clock on sampling clock line 371. The sampling clock is generated with a frequency less than the maximum sampling frequency of ADC 310. Other forms of circuit can be implemented to generate a signal with desired sampling frequency on sampling clock 371. The generated frequency needs to be less than the maximum sampling frequency of ADC 310, but be able to cause ADC 310 to sample a sufficient number of times to reasonably represent the image encoded in the analog display signal received on line 301.

In one embodiment, clock generator 350 generates a clock signal (OCLK) with an optimal frequency and pixel qualifier generator and NAND gate operate to generate ½ the frequency of OCLK frequency for 2:1 interleaved sampling. However, other frequencies (e.g., to implement 3:1 interleaved sampling) can be chosen without departing from the scope and spirit of the present invention.

Even though the smaller image represented by these sampled pixels is upscaled later, it should be appreciated that some level of detail may be lost in the upscaled image when compared to the original image represented by analog display signal received on line 301. However, the differences may not be perceivable by human eye due to the averaging phenomenon of the human eye as is well known in the art. An embodiment of pixel qualifier generator 360 will be explained in detail below.

Interpolator 390 compensates for the downscaling which results from the slower sampling frequency (compared to optimal frequency). For example, assuming that the sampling frequency is ½ of the optimal frequency, interpolator 390 generates two pixels for each pixel received. Any of various interpolation techniques known in the art can be employed.

The interpolation can be based on several adjacent pixels for optimal suppression of spectral images caused by the upscaling process. For example, with reference to FIG. 1, assuming pixels represented by 'O' are generated by sampling, pixel 110 can be generated by interpolating pixels 111–118. Alternatively, to avoid large buffers, only pixels in the same line can be used to generate the additional pixels. For example, pixel 110 can be generated from pixels 114 and 115. Thus, the output of interpolator 390 includes a number of pixels equal to those that would result if analog display signal were to be sampled at the optimal frequency.

Time base converter 320 upscales or downscales the source image represented by analog signal if necessary. Such upscaling or downscaling is typically performed to fit the image into an area of a desired size on a digital display screen 340. An embodiment for upscaling is described in co-pending patent application entitled, "A Method and Apparatus for Upscaling an Image", Filed Feb. 24, 1997, having Ser. No. 08/804,623 and Attorney Docket Number: PRDN-0001. The clock signals required for upscaling are provided by clock generator 350.

Panel interface 350 generates the display signals from the RGB pixel data to generate the destination image on digital display screen 340. The operation of panel interface 350 needs to be compatible with the structure and design of display screen 340.

Thus, using interpolator 390 the present invention upscales the image to compensate for the lower sampling frequency driving ADC 310. An alternative embodiment of digital display unit 270 which does not require interpolator 390 will be described below.

6. Alternative Embodiment of Digital Display Unit

Figure 3B:
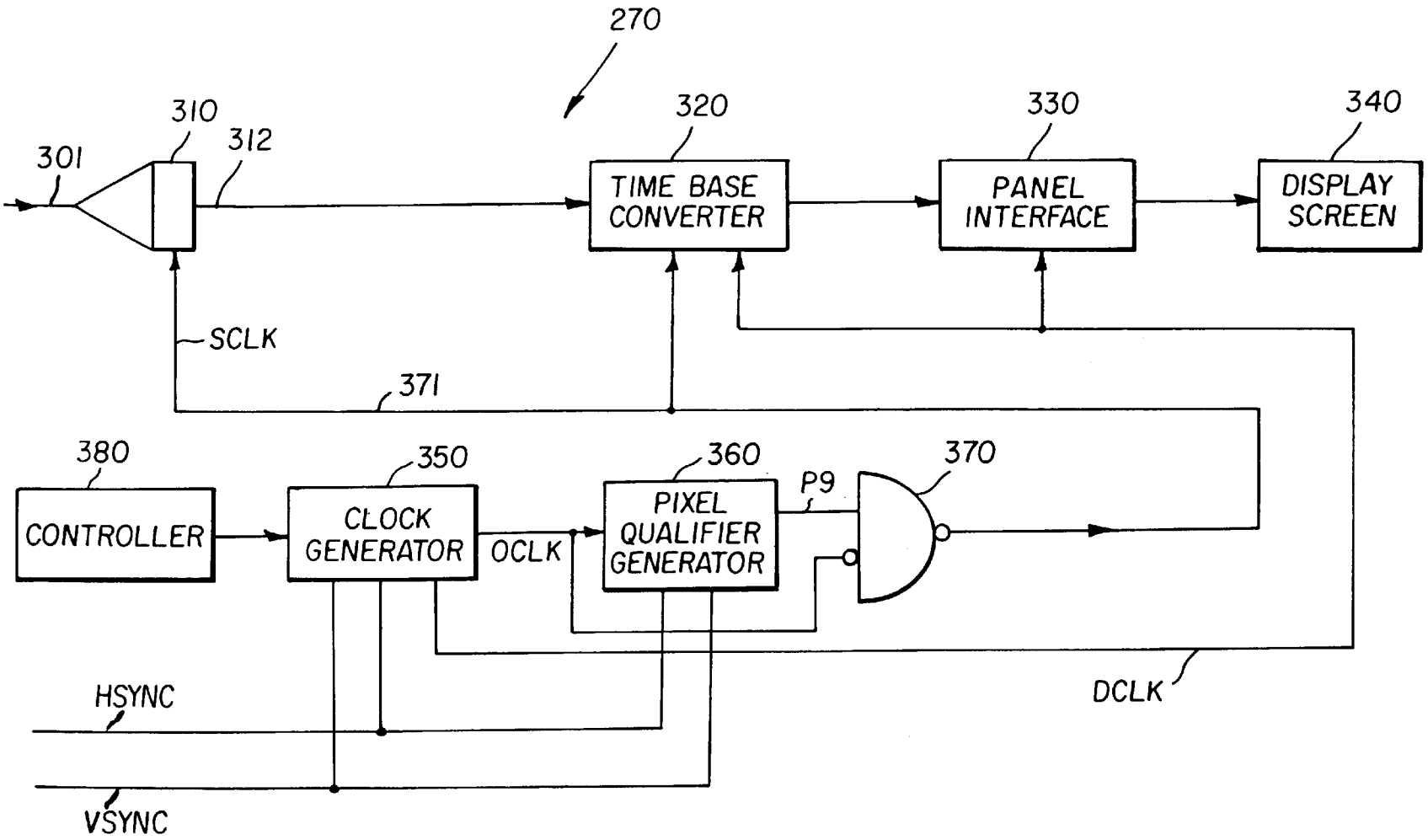
FIG. 3B is a block diagram of an alternative embodiment of a digital display unit including an analog to digital converter (ADC) illustrating the manner in which an image encoded in an analog signal can be displayed even if the maximum sampling frequency of the ADC is less than an optimal sampling frequency of the analog display signal.

FIG. 3B is an alternative embodiment of display unit 270. The embodiment of FIG. 3B contains all the components shown in FIG. 3A except interpolator 390. Similar components are referred by same reference numbers and labels in the two Figures. In this embodiment, time base converter 320 can be configured to perform the expansion performed by interpolator 390 of FIG. 3A.

For example, with reference to FIG. 1, if ADC 310 is sampled at an optimal sampling frequency, 800×600 pixel data elements may be generated. Assuming digital display screen 340 has a resolution of 1024×768, time base converter 320 can be configured to upscale 800×600 pixel data elements to 1024×768. On the other hand, if ADC 310 is made to perform 2:1 interleaved sampling, only 400×600 pixels will be generated by ADC 310. In this case, time base converter 320 needs to be configured to upscale from 400×600 pixel data elements to 1024×768.

Such upscaling can be performed using any upscaler. However, an embodiment for upscaling is described in co-pending patent application entitled, "A Method and Apparatus for Upscaling an Image", Filed Feb. 24, 1997, having Ser. No. 08/804,623 and Attorney Docket Number: PRDN-0001, which is incorporated in its entirety herewith. The number of pixels per each horizontal line provided for each horizontal line may need to be configured to 400 (instead of 800 used when sampled at optimal frequency), and the number of pixels per line in the upscaled image needs to be configured to 1024. Once so configured, time base converter 320 generates an upscaled image.

It should be understood that the specific examples of above are provided for illustration purpose only. Various modifications to these examples which are within the scope and spirit of the present invention will be apparent to one skilled in the art by reading the description provided herein.

In the embodiments described with reference to FIGS. 3A and 3B, pixel qualifier generator 360 has been described to facilitate generating a sampling clock which causes ADC 310 to perform interleaved sampling. An embodiment of pixel qualifier generator 360 will be explained now in detail with reference to FIGS. 4 and 5.

7. Example Implementation of Pixel Qualifier Generator for Interleaved Sampling

Figure 4:
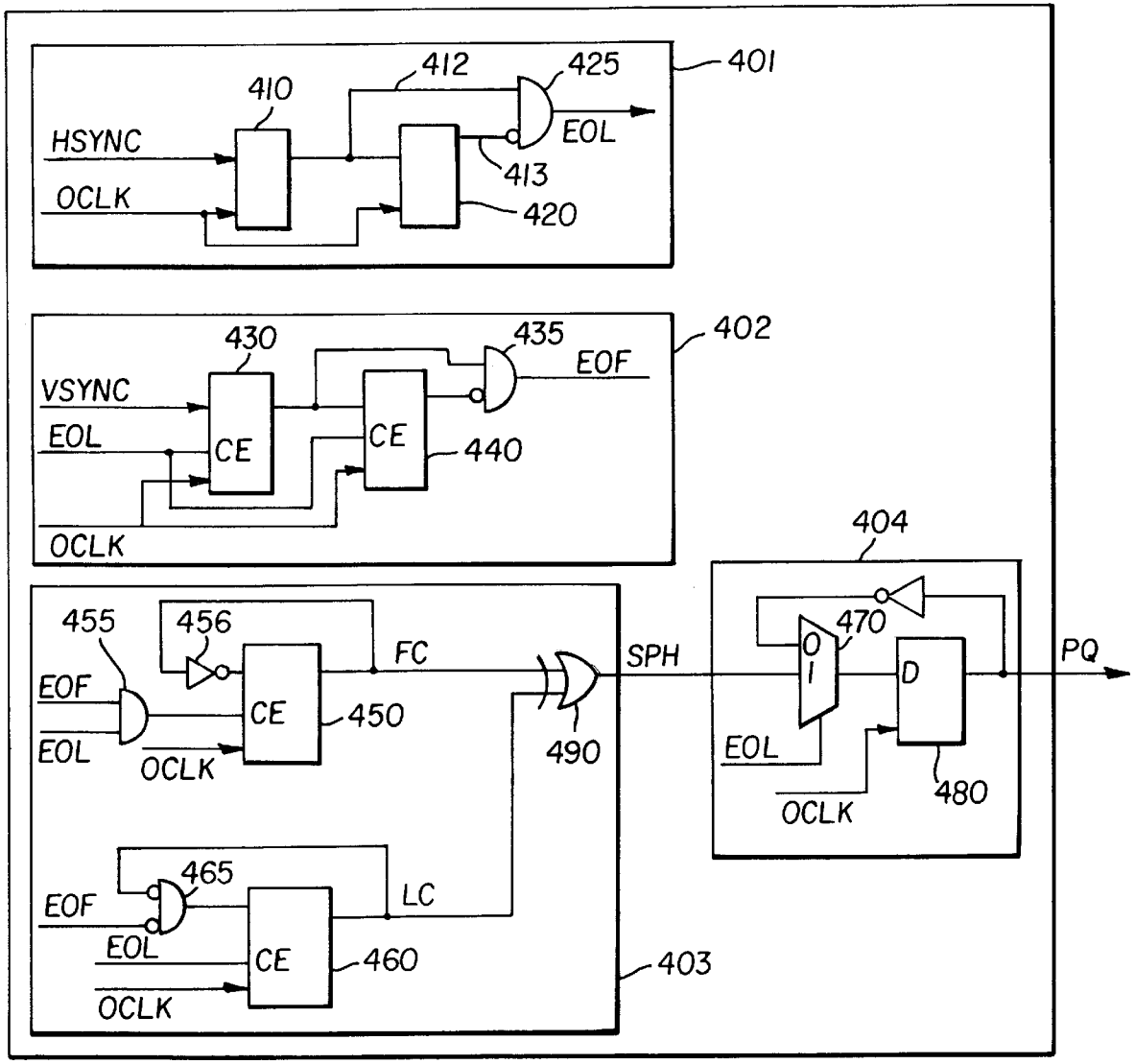
FIG. 4 is a block diagram of an example implementation of a pixel qualifier generator which facilitates the generation of a sampling clock having a lower frequency that the maximum sampling frequency of the ADC.

FIG. 4 is a block diagram of a circuit illustrating an example implementation of pixel qualifier generator 360. Broadly, block 401 generates an EOL (end of line) high signal for one OCLK clock period on a rising edge of HSYNC signal. Block 402 generates an EOF (end of frame) high signal on a VSYNC high state after EOL high is received. That is, EOF is raised to high once for each frame and the timing is controlled by EOL. EOF remains at a high level for the duration of a horizontal line. Block 403 generates an SPH (Sampling Phase) signal which is alternates between logical high and low values for each horizontal line. Block 404 generates a PQ (pixel qualifier) signal which alternates between logical high and low values for each OCLK period. The value for the first pixel on a horizontal line is controlled by the SPH signal. The details of each block are explained below with reference to FIGS. 4 and 5.

Figure 5:
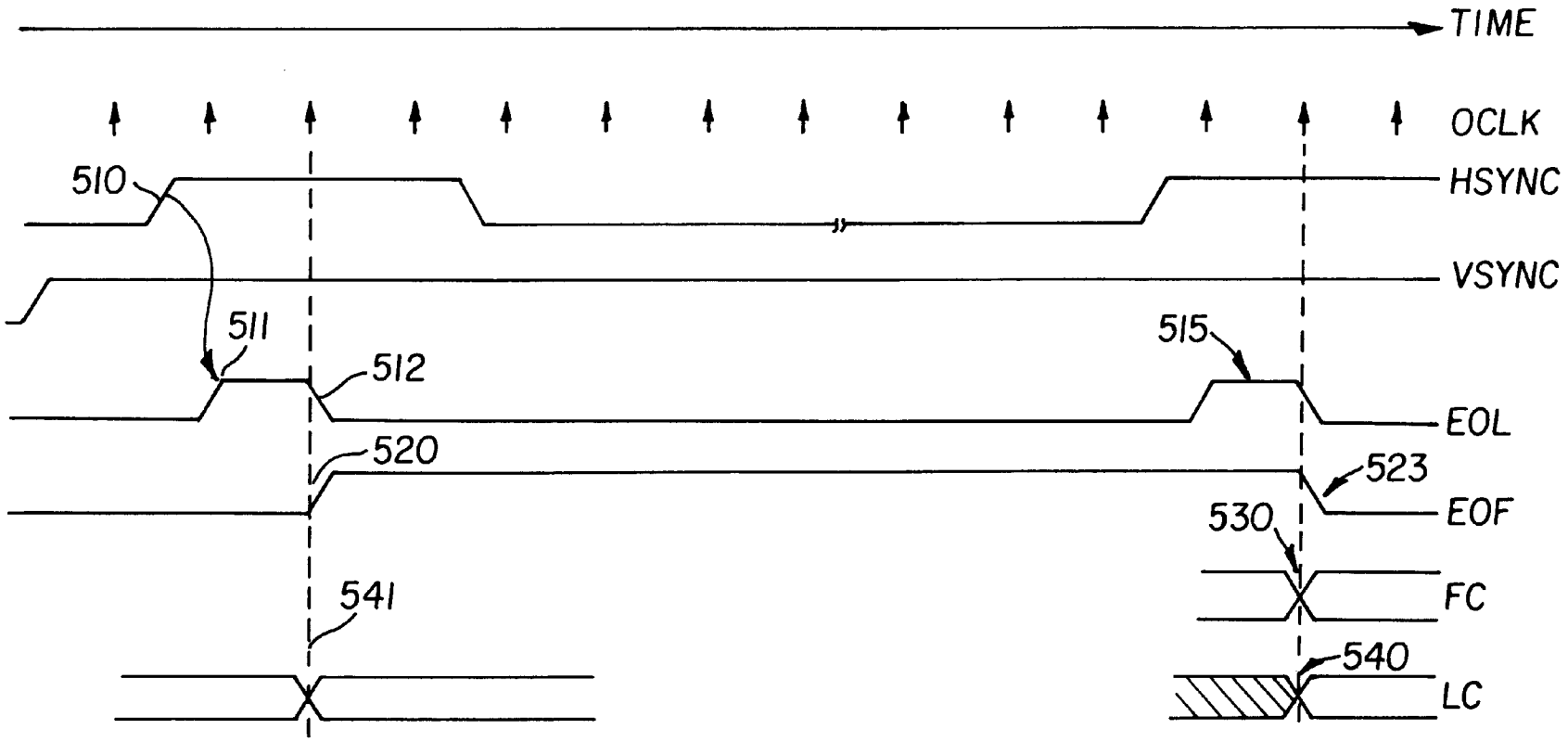
FIG. 5 is a timing diagram illustrating the timing relationship between various signals used and generated by pixel qualifier generator in one embodiment.

FIG. 5 is timing diagram illustrating the relationship between various signals used and generated by pixel qualifier generator 360. The rising edges of OCLK signal (generated by clock generator 350) are shown at the top. HSYNC and VSYNC are synchronization signals received along with analog display signal (in SVGA environment). The remaining signals will be explained with reference to the blocks of FIG. 4 below.

Block 401 is explained with reference to FIGS. 4 and 5. Flip-flop 410 and 420 are clocked by OCLK signal. Flip-flop 410 receives HSYNC signal as input. The output of flip-flop 410 is connected to the input of flip-flop 420. AND gate 425 receives as input HSYNC signal from flip-flop 410 and an inverted signal of a delayed HSYNC signal from flip-flop 410 on lines 412 and 413 respectively, and generates an EOL signal. Accordingly, the EOL signal is shown being driven to a high state on a rising edge of HSYNC signal (shown at 510) for a duration of a OCLK clock cycle (between 511 and 512) in FIG. 5.

As to block 402, flip-flops 430 and 440 are clocked by OCLK signal. The clock enable (CE) input of both flip-flops 430 and 440 is connected to EOL signal. Flip-flop 430 receives VSYNC signal as input. The output of flip-flop 430 is connected to the input of flip-flop 440. AND gate 435 receives as inputs the outputs of flip-flops 430 and 440, and generates a EOF signal. As the clock enable inputs of the flip-flops are coupled to EOL signal, EOF signal is shown (in FIG. 5) going high during a OCLK clock cycle after EOL goes high. EOF remains at a high level until a subsequent EOL signal is received (as clock enable). Thus, EOF signal is shown going low at 523.

As to block 403, Flip-flops 450 and 460 are driven by OCLK as clock signal. AND gate 455 has EOF and EOL as inputs. The output of AND gate is connected to the clock enable input of flip-flop 450. The output of flip-flop 450 is fed back as input to flip-flop 450 via inverter 456. Accordingly, the output FC (frame count) is an inverted value of previous output when both EOL and EOF are at a high signal level. As EOL and EOF are both at a high signal level at the end of a horizontal line after receiving a VSYNC, FC signal value changes every frame. An example change is shown at 530.

AND gate 465 receives inverted values of EOF and output of flip-flop 460 as inputs. Thus, the output of AND gate 465 is zero between time corresponding to points 520 and 530. As the clock enable input of flip-flop 460 is connected EOL, the output LC (line count) is at zero after the second HSYNC pulse (high value) as shown at 540. As EOF continues to be at low logical value for the remaining portion of the frame, the LC signal alternates between zero and one in response to each EOL high. An example of such a transition is shown at 541.

XOR gate 490 receives FC and LC as inputs. FC value alternates between zero and one in response to VSYNC signals, but remains at the same level for the remaining portion of the frame once the transition occurs as explained above. LC starts at a value of zero on the second HSYNC rising edge after receiving a VSYNC signal, and alternates between zero and one values in response to each EOL signal as also explained above.

Thus, the signal SPH is at one logical value at a beginning of active display potion of odd frames and at the other logical value at a beginning of display portion for even frames. As LC value changes in response to each EOL high logical value, the signal value SPH also changes from one value to other in corresponding to each EOL high logical value.

As to block 404, flip-flop 480 is driven by OCLK signal. Multiplexor 470 accepts the SPH signal and inverted output of flip-flop 480 as inputs. Multiplexor 470 selects the output of SPH as output in response to a high logical value of EOL. When EOL is at a low logical level, the inverted output of flip-flop 480 is selected. The output of multiplexor 470 is provided as input to flip-flop 480.

Thus, the output PQ (pixel qualifier) of flip-flop 480 starts with a value equal to SPH when a EOL high is received and switches between zero and one thereafter in response to each rising edge of OCLK signal. As noted earlier, the value of SPH starts at a different value for odd and even frames, and alternates (toggles) between zero and one in response to each EOL high value (i.e., for each new line). As a result, one half of the pixel positions (e.g., those represented by 'O' in FIG. 1) are sampled for odd frames, and the remaining half of the pixel positions are sampled for even frames.

Continuing with reference to FIGS. 3 and 4, the PQ output of flip-flop 480 is provided as input to NAND gate 370. As NAND gate has the inverted value of OCLK signal as the other input, the OCLK signal is propagated (or provided) as sampling clock (SCLK) only when PQ signal is at a high logical value. As should be apparent from the above description, the sampling clock causes ADC 310 to perform 2:1 interleaved sampling.

As further described above, an image represented by the pixels resulting from interleaved sampling is upscaled prior to being displayed. The image may be upscaled to fit the entire area of a digital display screen. In the alternative, the image may be interpolated (and upscaled) to compensate for the downsizing that results from the interleaved sampling (as opposed to sampling at an optimal frequency).

8. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of displaying each of a plurality of images on a digital display unit, each of said plurality of images being encoded in one of a plurality of frames of an analog display signal received by said digital display unit, said digital display unit being included in a computer system, said analog display signal having an associated optimal sampling frequency for sampling said analog display signal, said method comprising the steps of:

(a) receiving said analog display signal in said digital display unit;

(b) determining whether said optimal sampling frequency is greater than the maximum sampling frequency of an analog to digital converter (ADC) included in said digital display unit;

(c) sampling each of said plurality of frames encoded in said analog display signal at a lower sampling frequency than said optimal sampling frequency to generate a plurality of sampled pixel data elements if said optimal sampling frequency is greater than the maximum sampling frequency of an analog to digital converter (ADC) included in said digital display unit;

(d) upscaling a smaller image represented by said plurality of sampled pixel data elements to generate an upscaled image, wherein additional pixel data elements are generated based on said plurality of sampled pixel data elements to generate said upscaled image; and (e) displaying said upscaled image on a digital display screen.

2. The method of claim 1, further comprising the steps:

(f) sampling each of said plurality of frames encoded in said analog display signal at said optimal sampling frequency if said optimal sampling frequency is not greater than the maximum sampling frequency of an analog to digital converter (ADC) included in said digital display unit; and (g) displaying said images according to the sampled values generated in step (f).

3. The method of claim 1, wherein step (c) comprises the step of sampling each of said plurality of frames using interleaved sampling.

4. The method of claim 3, wherein step (c) comprises the further step of sampling each said plurality of frames using 2:1 interleaved sampling.

5. The method of claim 4, wherein step (d) comprises the step of interpolating said plurality of pixels to generate twice the number of pixels contained in said plurality of pixels.

6. The method of claim 1, wherein step (c) comprises the step of determining said optimal sampling frequency by multiplying the number of frames received in each second, the number of horizontal lines in each of said plurality of frames and a desired number of samples per each horizontal line.

7. The method of claim 1, wherein step (d) comprises the step of upscaling said smaller image to fit a size of a digital display screen.

8. A display circuit for use in a digital display unit of a computer system, said display unit including an analog to digital converter (ADC) for sampling an analog display signal received from a graphics source, an optimal sampling frequency being associated with said analog display signal, said display circuit for generating display signals for a digital display screen, said display circuit comprising:

a clock generator circuit for generating a clock signal;

a controller for determining whether said optimal sampling frequency is greater than a maximum sampling frequency of said ADC;

a pixel qualifier circuit coupled to said controller and said clock generator circuit, said pixel qualifier circuit receiving said clock signal and generating a sampling clock having a frequency lesser than the maximum sampling frequency if said optimal sampling frequency is greater than a maximum sampling frequency of said ADC, wherein said sampling clock having a frequency lesser than the maximum sampling frequency is used by said ADC to sample said analog display signals to generate a plurality of sampled pixel data elements; and an upscaler for upscaling a smaller image represented by said plurality of sampled pixel data elements to generate an upscaled image, wherein said upscaler generates additional pixel data elements based on said sampled pixel data elements to generate said upscaled image, wherein said upscaled image is displayed on a digital display screen.

9. The display circuit of claim 8, wherein said clock signal generated by said clock generator circuit has a frequency equal to said optimal sampling frequency.

10. The display circuit of claim 9, wherein said ADC is coupled to said clock generator circuit to receive said clock signal with said optimal sampling frequency if said optimal sampling frequency is not greater than a maximum sampling frequency of said ADC, where forth said ADC samples said analog display signal at said optimal sampling frequency.

11. The display circuit of claim 9, wherein said pixel qualifier circuit generates said clock signal with a frequency of half of said optimal sampling frequency such that said ADC performs 2:1 interleaved sampling.

12. The display circuit of claim 11, further comprising an interpolator for interpolating said plurality of pixels to generate twice the number of pixels contained in said plurality of pixel data elements.

13. The display circuit of claim 11, wherein said analog display signal comprises a plurality frames including even frames and odd frames, each of said plurality of frames comprising a plurality of horizontal lines including even lines and odd lines, and wherein said pixel qualifier circuit comprises:

a frame counting circuit for generating a first logical value when one of said even frames is received and a second logical value when one of said odd frames is received;

a line counting circuit for generating a first logical value when one of said even lines is received and a second logical value when one of said odd lines is received;

an XOR gate coupled to receive the values generated by said line counting circuit and said frame counting circuit, wherein the output of said XOR gate indicates whether a first half or a second half of a plurality of optimal positions are to be sampled for 2:1 interleaved sampling, wherein said plurality of optimal positions correspond to positions which would be sampled if said analog display signal were sampled at an optimal sampling frequency.

14. A digital display unit for use in a computer system, said digital display unit for displaying a plurality of images encoded in an analog display signal received from a graphics source, said analog display signal having an associated optimal sampling frequency said digital display unit comprising:

an analog to digital converter (ADC) for receiving said analog display signal and a sampling clock, said ADC generating a plurality of sampled pixel data elements by sampling said analog display signal at a sampling frequency of said sampling clock;

a clock generator circuit for generating a clock signal;

a controller circuit for determining whether said optimal sampling frequency is greater than a maximum sampling frequency of said ADC;

a pixel qualifier circuit coupled to said controller and said clock generator circuit, said pixel qualifier circuit receiving said clock signal and generating said sampling clock having a frequency lesser than the maximum sampling frequency if said optimal sampling frequency is greater than a maximum sampling frequency of said ADC, wherein said sampling clock having a frequency lesser than the maximum sampling frequency is used by said ADC to sample said analog display signals to generate a plurality of sampled pixel data elements; and an upscaler for upscaling a smaller image represented by said plurality of sampled pixel data elements to generate an upscaled image, wherein said upscaler generates additional pixel data elements based on said sampled pixel data elements to generate said upscaled image;

a digital display screen for displaying said upscaled image; and a panel interface coupled to said upscaler for receiving pixel data elements representative of said upscaled image and generating display signals to display said upscaled image on said digital display screen.

15. The digital display unit of claim 14, wherein said clock signal generated by said clock generator circuit has a frequency equal to said optimal sampling frequency.

16. The digital display unit of claim 15, wherein said ADC is coupled to said clock generator circuit to receive said clock signal with said optimal sampling frequency if said optimal sampling frequency is not greater than a maximum sampling frequency of said ADC, where forth said ADC samples said analog display signal at said optimal sampling frequency.

17. The digital display unit of claim 15, wherein said pixel qualifier circuit generates said clock signal with a frequency of half of said optimal sampling frequency such that said ADC performs 2:1 interleaved sampling.

18. The digital display unit of claim 17, further comprising an interpolator for interpolating said plurality of pixels to generate twice the number of pixels contained in said plurality of pixel data elements.

19. A computer system for displaying each of a plurality of images on a digital display unit, each of said plurality of images being encoded in one of a plurality of frames of an analog display signal, said analog display signal having an associated optimal sampling frequency for sampling said analog display signal, said method comprising the steps of:

means for receiving said analog display signal in a digital display unit comprised in said computer system;

means for determining whether said optimal sampling frequency is greater than the maximum sampling frequency of an analog to digital converter (ADC) included in said digital display unit;

means for sampling each of said plurality of frames encoded in said analog display signal at a lower sampling frequency than said optimal sampling frequency to generate a plurality of sampled pixel data elements if said optimal sampling frequency is greater than the maximum sampling frequency of an analog to digital converter (ADC) included in said digital display unit;

means for upsealing a smaller image represented by said plurality of sampled pixel data elements to generate an upscaled image, wherein said means for upscaling generates additional pixel data elements based on said sampled pixel data elements to generate said upscaled image; and means for displaying said upscaled image on a digital display screen.

* * * * *